US012607425B2

(12) United States Patent
Booth et al.

(10) Patent No.: US 12,607,425 B2
(45) Date of Patent: Apr. 21, 2026

(54) OPPOSING FORCE RECOIL REDUCTION IN A FIREARM

(71) Applicants: Darren J Booth, Lavalette, WV (US); Steven Clark Butterfield, Carthage, MO (US)

(72) Inventors: Darren J Booth, Lavalette, WV (US); Steven Clark Butterfield, Carthage, MO (US)

(73) Assignee: 3D Defense, LLC, Lavalette, WV (US)

( * ) Notice: Subject to any disclaimer, the term of this patent is extended or adjusted under 35 U.S.C. 154(b) by 122 days.

(21) Appl. No.: 18/744,772

(22) Filed: Jun. 17, 2024

(65) Prior Publication Data

US 2026/0049780 A1 Feb. 19, 2026

(51) Int. Cl.
*F41A 3/86* (2006.01)
*F41A 19/14* (2006.01)

(52) U.S. Cl.
CPC ..... *F41A 3/86* (2013.01); *F41A 19/14* (2013.01)

(58) Field of Classification Search
CPC ..... F41A 3/86; F41A 19/14
USPC ..... 42/1.06
See application file for complete search history.

(56) References Cited

U.S. PATENT DOCUMENTS

| | | | | |
|---|---|---|---|---|
| 3,483,648 | A * | 12/1969 | Speckhart | F41C 7/00 42/15 |
| 4,447,975 | A * | 5/1984 | Ljutic | F41A 3/56 42/76.01 |
| 10,267,581 | B2 * | 4/2019 | Hangen | F41A 5/10 |
| 11,231,248 | B2 * | 1/2022 | Steimke | F41A 25/12 |
| 11,486,667 | B2 * | 11/2022 | Simek | F41A 19/13 |
| 2012/0144992 | A1 * | 6/2012 | Landies | F41A 9/10 89/128 |
| 2015/0377583 | A1 * | 12/2015 | Furusho | F41A 3/56 42/1.06 |
| 2022/0244010 | A1 * | 8/2022 | Puha | F41A 25/12 |

* cited by examiner

*Primary Examiner* — Samir Abdosh
(74) *Attorney, Agent, or Firm* — Bret J Petersen

(57) ABSTRACT

A firearm which provides recoil reduction using the kinetic energy of the hammer to cancel a portion of the bolt's recoil after a round has been fired. After the bolt starts to move rearward in response to the detonation, the hammer's forward kinetic energy is transferred onto the bolt by striking it at the moment the bolt starts to travel rearward or after the bolt has started its rearward motion.

20 Claims, 18 Drawing Sheets

Hammer Cocked, Bolt Forward, Round Chambered

Hammer Moving Forward

Hammer Cocked, Bolt Forward, Round Chambered

Hammer Moving Forward

Hammer Striking Firing Pin

Hammer Striking Bolt

Bolt and Hammer Moving Rearward

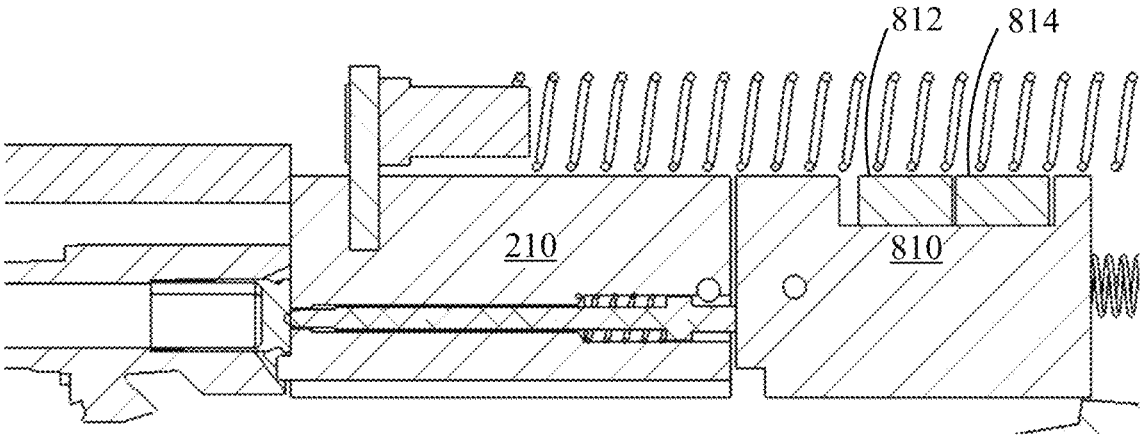
FIG. 8A
FIG. 8B
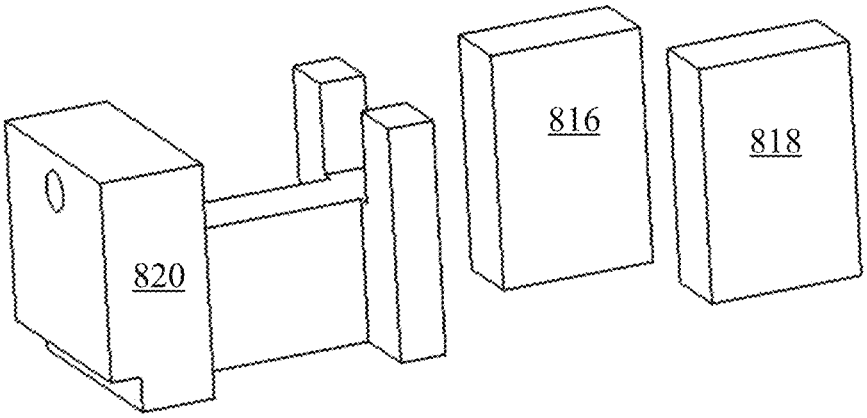

OPPOSING FORCE RECOIL REDUCTION IN A FIREARM

BACKGROUND

Recoil in a firearm is the rearward momentum generated by the firearm upon firing. When a projectile or bullet is fired, the mass and velocity of a projectile exerts an equal and opposite reaction in the firearm behind it. This relationship is defined as "free recoil" in the firearm industry. Free recoil, in turn, results in muzzle rise. Muzzle rise is defined as the immediate, post-fire angular velocity of the firearm about its center of force. The center of force is determined by both the user's hand pressure across the grip and the handgun's own center of mass. Unless properly adjusted for by the firearm and the user, the recoil of a firearm may cause the user to fire inaccurately and even miss the intended target. As caliber size increases, so does the recoil of the firearm. Efforts have been made over the years to reduce the amount of recoil generated by a firearm.

SUMMARY

In some aspects, the techniques described herein relate to a firearm with an opposing force recoil reduction system including: a barrel with a chamber for holding a round; a bolt that moves within an upper housing from a rearward position to a forward position in contact with the barrel; a firing pin within the bolt for contacting the round to fire the round; a hammer that moves behind the bolt in the upper housing; a trigger assembly with a sear that holds the hammer in a cocked position for firing; at least one hammer spring that moves the hammer to engage the firing pin and the bolt in response to a user operating the trigger assembly causing the firing pin to move forward to fire the round; wherein the hammer engages the bolt after the round is fired and as the bolt moves rearward in response to the fired round to transfer kinetic energy of the hammer to the bolt reducing recoil of the firearm.

In some aspects, the techniques described herein relate to a method for reducing recoil in a firearm including: a. putting the firearm in a cocked state with a hammer held in a rearward position by a sear and a bolt in a forward position against a barrel with a chambered round; b. releasing the hammer from the sear in response to a user activating a trigger; c. accelerating the hammer forward by a hammer spring to strike a firing pin in the bolt; d. driving the firing pin into a primer of the chambered round to fire the round; e. the bolt moving rearward due to recoil of the fired round; and f. the hammer striking the bolt and transferring kinetic energy of the hammer to the rearward moving bolt.

This Summary identifies example features and aspects and is not an exclusive or exhaustive description of the disclosed subject matter. Whether features or aspects are included in or omitted from this Summary is not intended as indicative of relative importance of such features. Additional features and aspects are described, and others will become apparent to persons skilled in the art upon reading the following detailed description and viewing the drawings that form a part thereof.

BRIEF DESCRIPTION OF THE DRAWINGS

The drawing figures depict one or more implementations in accord with the present teachings, by way of example only, not by way of limitation. In the figures, like reference numerals refer to the same or similar elements. Furthermore, it should be understood that the drawings are not necessarily to scale.

FIG. 8A illustrates a first three-piece hammer.

FIGS. 8B and 8C illustrate a second three-piece hammer.

DETAILED DESCRIPTION

Figure 1:
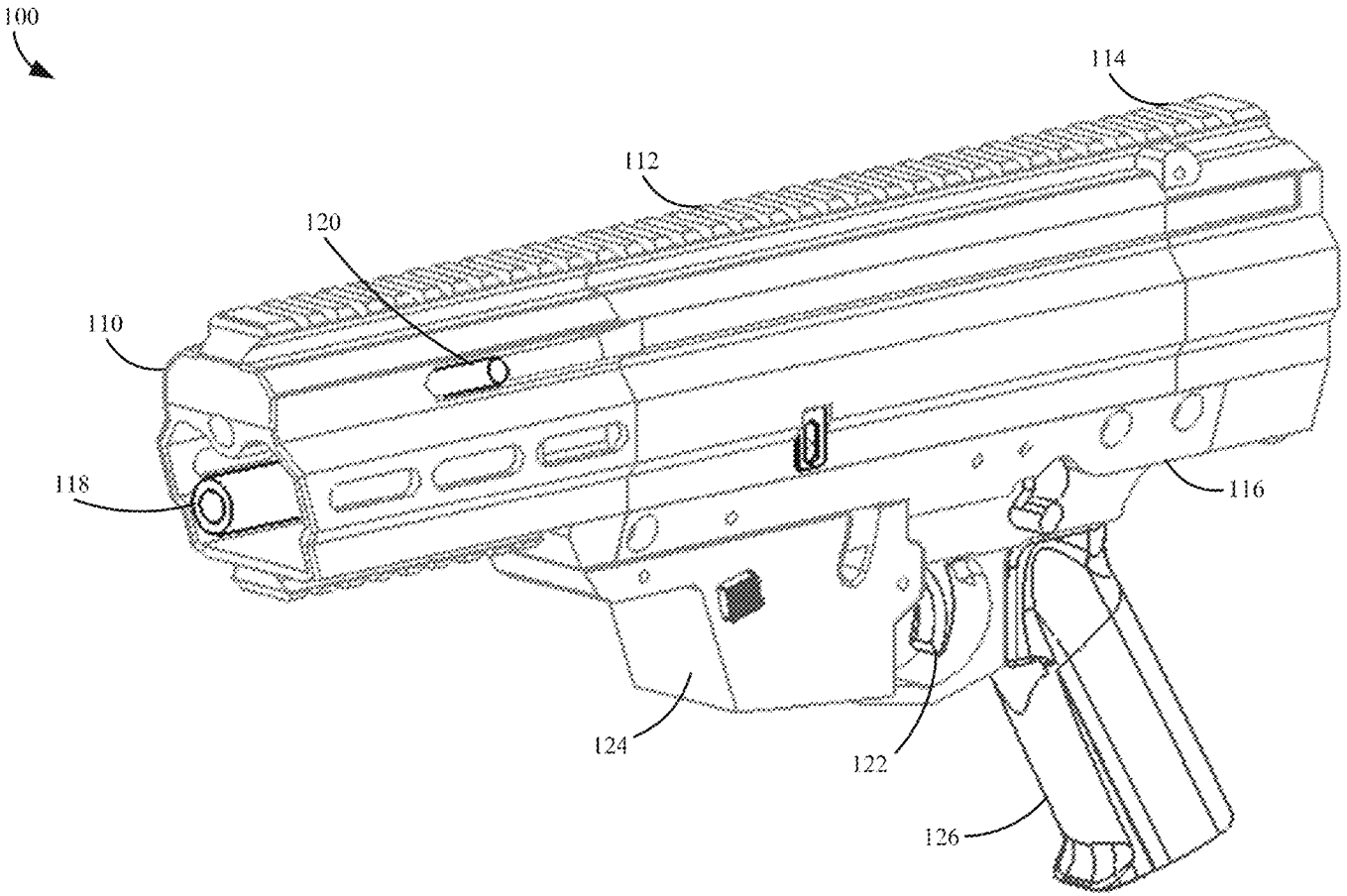
FIG. 1 is a full isometric view showing an example implementation of a firearm 100 with an opposing force recoil reduction system.

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The instant disclosure describes a technical solution to the problem of firearm recoil. The opposing force recoil reduction system described herein greatly reduces the recoil impulse and barrel rise that is inherent to all semi-automatic and automatic firearms. The primary components of the system include a bolt, a custom length firing pin and a large mass hammer. These components are further described below.

The opposing force recoil reduction system described herein uses the kinetic energy of the hammer as the opposing force to cancel a portion of the bolt's recoil after the round has been detonated. This is done by transferring the forward kinetic energy of the hammer into the bolt by the hammer striking the bolt just after the moment of detonation or after the bolt has started to travel rearward. The remaining kinetic energy in the bolt is used to push the hammer rearward to return to its firing position. Although it is possible to eliminate all recoil energy, the purpose of this system is to not eliminate all recoil. There must be enough energy remaining in the bolt to allow the hammer and bolt to complete the cycle.

The opposing force recoil reduction system described herein is a firing system for semi auto fire and automatic firearms designed to greatly reduce recoil and barrel rise without complicated bolt locking systems. Traditional locking systems usually lock the bolt to the receiver for a short period of time. During this time energy is transferred into the receiver which is directly transferred to the shoulder. After the bolt unlocks, it is then launched rearward where it strikes the end of the receiver allowing more recoil to be transferred to the shoulder. With an opposing force recoil reduction system, recoil is absorbed and spread out over time to lessen the recoil experienced by the operator. Timing is important to absorb the recoil as described further below. One aspect of the timing is the firing pin length. The firing pin must be an appropriate length with respect to the other components to achieve the desired timing. If the firing pin is too short the hammer will strike the rear face of the bolt before the bolt starts its rearward motion which in turn will cause inaccuracy due to the entire firearm being pushed forward before the projectile exits the barrel. The firing pin length is based on the hammer speed. The hammer speed can be reduced or increased simply by increasing or decreasing the strength and length of the hammer springs or changing the mass of the hammer.

FIG. 1 is a full isometric view showing an example implementation of a firearm 100 with an opposing force recoil reduction system. The firearm 100 includes several housing portions, including: a barrel retainer 110, an upper 112, an endcap 114, and a lower 116. The barrel retainer 110 houses the barrel 118. The charging handle 120 can be seen protruding from the barrel retainer 110. The endcap 114 is connected to the upper 112. The endcap retains the bolt and hammer springs as described below. The lower 116 includes a trigger assembly 122. The lower 116 further includes a magwell 124 that retains a magazine (not shown) which hold rounds in position for chambering. A handle 126 is connected to the lower 116 providing a grip for the user of the firearm.

Figure 2:
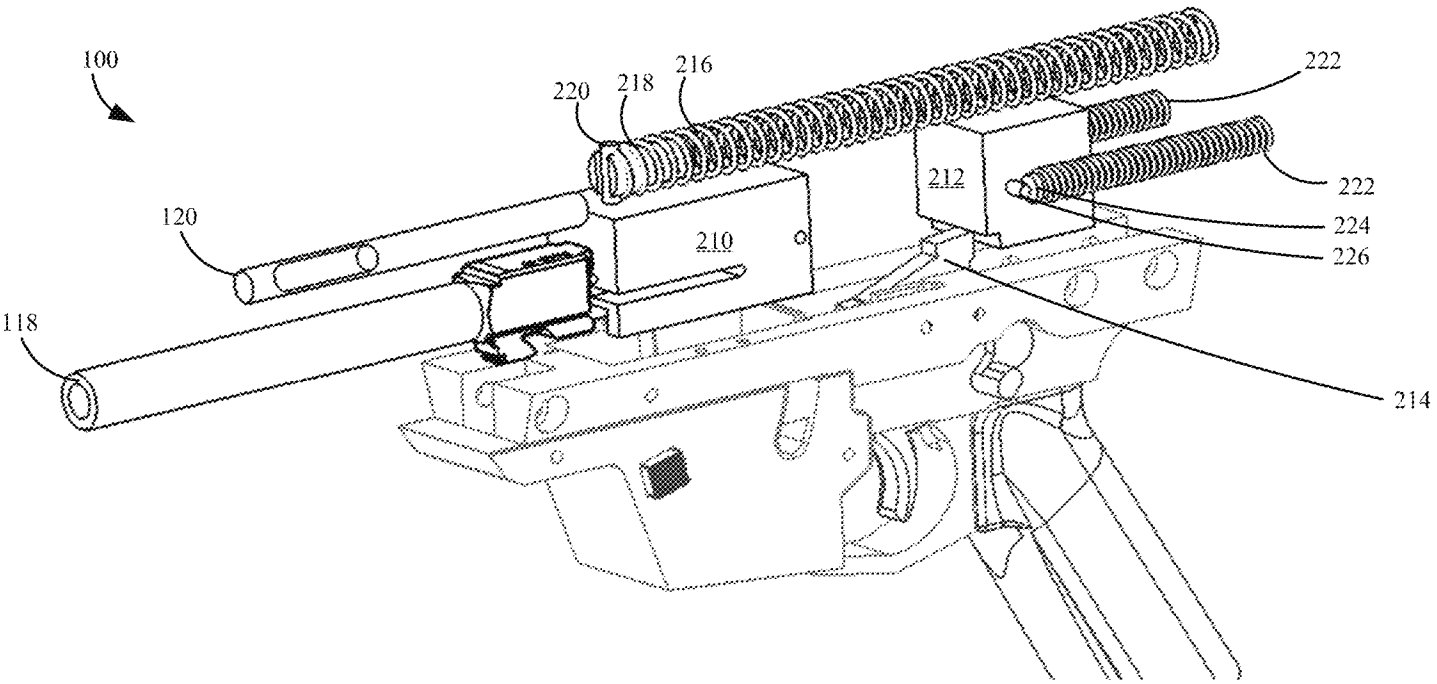
FIG. 2 shows the firearm 100 with portions of the housing removed.

FIG. 2 shows the firearm 100 with portions of the housing removed. The barrel 118 is clearly visible below the charging handle 120. A bolt 210 is shown contacting the barrel 118. In this illustration, a hammer 212 is shown in a rearward position being retained by a sear 214. The sear 214 is part of the trigger assembly 122 and controlled by the trigger. The bolt 210 is pushed forward into contact with a rear of the barrel 118 by a bolt recoil spring 216. The bolt spring connects to the bolt with a bolt spring guide 218 that contacts a bolt spring stud 220. The hammer 212 is urged forward against the sear by two hammer springs 222 on either side of the hammer 212. When the sear releases the hammer the hammer springs move the hammer towards the bolt as described below. The hammer springs connects to the hammer with a hammer spring guide 224 that contacts a hammer spring stud 226.

Figure 3:
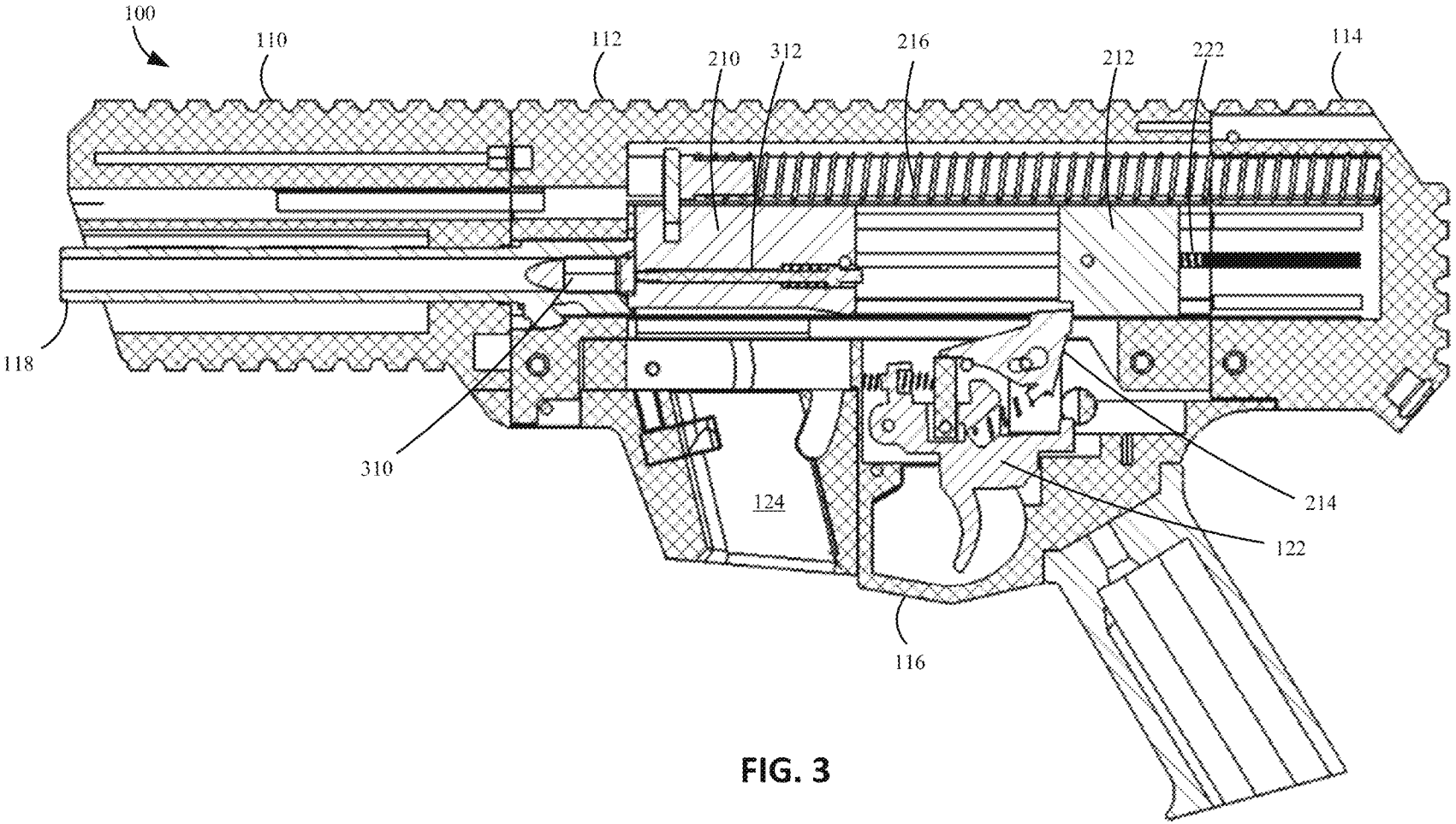
FIG. 3 illustrates a sectional view of the firearm.

FIG. 3 illustrates a sectional view of the firearm 100. Many of the same parts are visible in this view that were introduced in the previous figures including: the barrel retainer 110, the upper 112, the endcap 114, and the lower 116 with the trigger assembly 122 and the sear 214. The bolt 210 is shown contacting the barrel 118 which holds a round 310. The hammer 212 is shown in the rearward position being retained by the sear 214. The bolt 210 is held forward in contact with a rear face of the barrel 118 by a bolt recoil spring 216. One hammer recoil spring 222 is visible in contact with the hammer 212. A firing pin 312 is visible inside the bolt 210. These components are described further below.

Figure 4A:
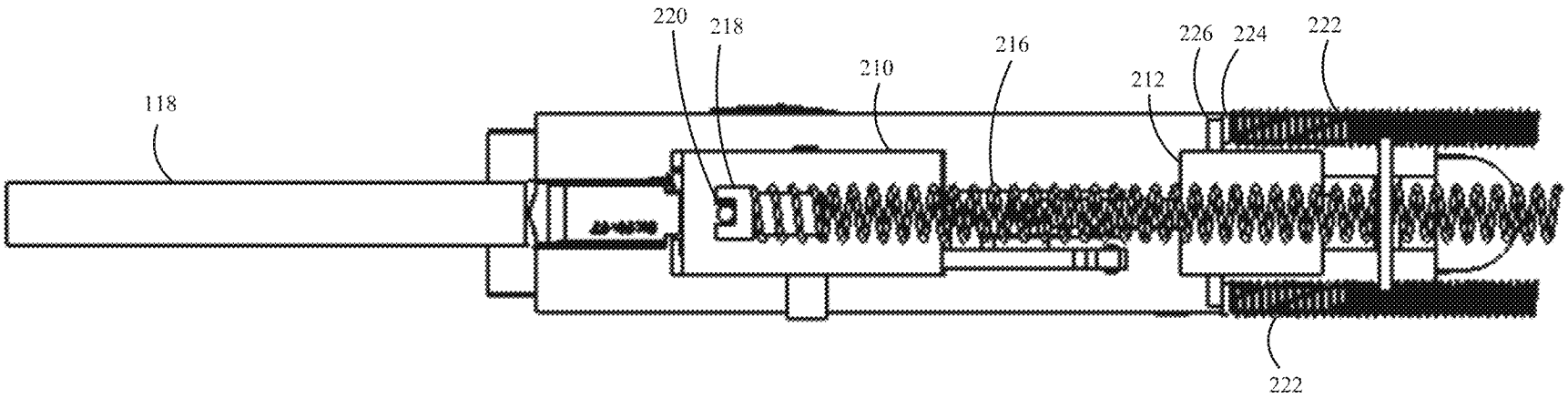
FIG. 4A illustrates a top cut-away view of the firearm 100 to show the bolt spring and hammer springs.

FIG. 4A illustrates a top view of the firearm 100 with the barrel retainer, upper and endcap removed to show the bolt recoil spring and hammer recoil springs. Many of the same parts are visible in this view that were introduced in the previous figures including: the bolt recoil spring 216, the bolt recoil spring guide 218 connected to the bolt recoil spring stud 220, two hammer recoil springs 222 on either side of the hammer 212 and each connected to the hammer with a hammer recoil spring guide 224 that contacts a hammer spring stud 226 on either side of the hammer 212.

Figure 4B:
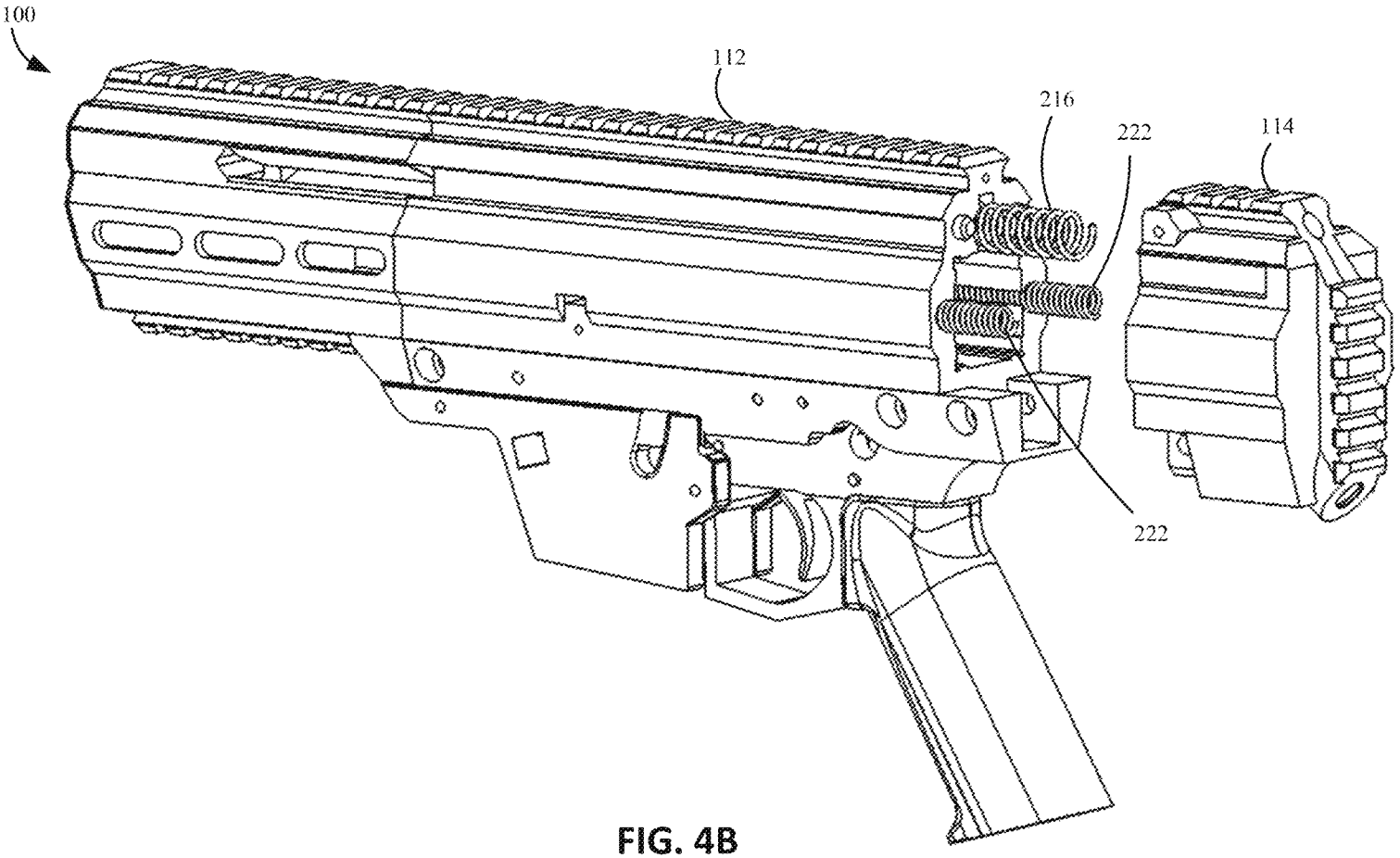
FIG. 4B illustrates a view of the firearm 100 with the endcap 114 removed.

FIG. 4B illustrates a view of the firearm 100 with the endcap 114 removed. In this view the bolt recoil spring 216 and the hammer recoil springs 222 are visible extending out of the upper 112. The bolt recoil spring 216 and the hammer recoil springs 222 are retained by slots in the upper 112 and corresponding slots the endcap 114.

Hammer

The hammer 212 introduced above is preferably an independent block of steel positioned directly behind the bolt 210. The hammer has a substantial mass compared to the mass of the bolt. The mass of the hammer 212 is determined by several factors but generally would be between about 20% to about 100% of the mass of the bolt 210. In a preferred example, the hammer is at least 50% of the mass of the bolt. In other examples the hammer could be less than 50% or more than 100%. The kinetic energy transferred from the hammer to the bolt depends on the mass of the hammer and the acceleration of the hammer due to the force (spring) pushing on the hammer. The combination of the hammer mass and the force are chosen to provide sufficient kinetic energy to absorb a portion of the rearward kinetic energy of the bolt from the detonated round and thereby reduce the recoil to the user.

Figure 8C:
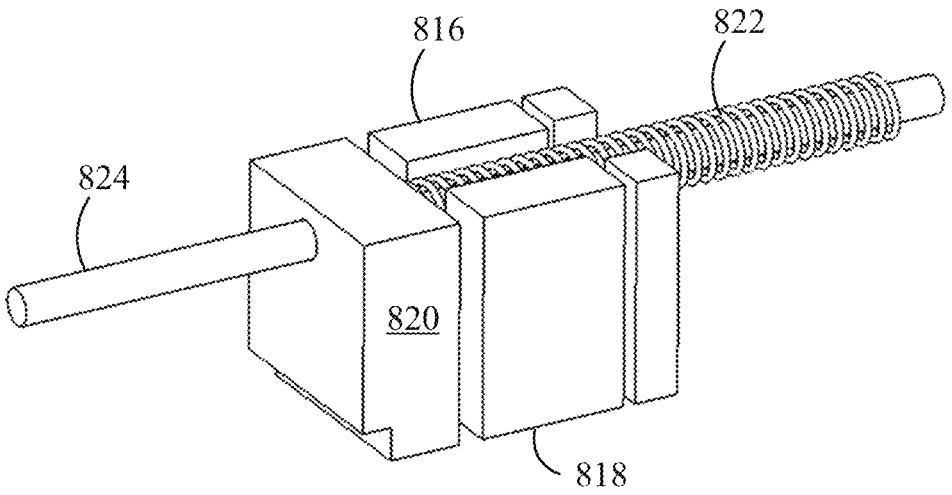

The hammer is independent of and is not connected to the receiver or lower. In some examples, the hammer is free floating in the upper 112 and utilizes one or more springs to launch it forward toward the bolt, in other examples, the hammer and bolt may ride on a rod or spring guide as shown in FIG. 8C. The hammer springs also assist in absorbing the remaining recoil. The hammer is preferably about the same height and width of the bolt so as to move within the upper or upper carrier with the bolt. The hammer will typically have a flat face that is perpendicular to its length which will make contact with the rear face of the bolt. The hammer could be rounded or have other features and thus not be flat. The hammer can be constructed of one or more pieces. A one-piece, two-piece, three-piece and four-piece hammer are described below. Other examples could include a hollow hammer filled with multiple weights such as lead shot. A multi-piece hammer could be used in most applications. As the bolt begins to recoil from the force of the fired round causing the bolt to move in a direction opposite the fired round, the hammer then engages the bolt with a force moving in the opposite direction of the bolt movement providing kinetic recoil reduction of the bolt. This is shown below in more detail with reference to FIG. 5A-5G.

Bolt

The bolt 210 in most cases will be a fabricated from steel. Its height and width will generally be the same as the hammer. In the illustrated examples the bolt and hammer are cuboid in shape. In an alternate example, the bolt and hammer could be cylindrical. The weight or mass of the bolt may be dependent on several factors including the power and caliber of the ammunition or round being used. The bolt can contain the firing pin and all components necessary for it to strip a round from the magazine and load the round into the barrel chamber. The bolt will also contain any components necessary to eject the fired casing. In the illustrated example, the rear face of the bolt is flat and perpendicular to its length for the hammer to make contact. The bolt's rear face will generally be the same height and width as the hammer face. The bolt will typically have a through hole centered on the barrel center for a firing pin.

Firing Pin

The firing pin 312 herein is similar to firing pins known in the prior art. The firing pin is constructed from a very hard material so that it can hit the primer of the round without any deformation or shrinkage. The opposing force recoil reduction system uses a firing pin with a specific length in order to achieve detonation timing as described herein to ensure the hammer hits the bolt at an appropriate time. The firing pin can use a dull tip to allow for deeper primer penetration without puncturing the primer. The length of the firing pin can vary because it is based on the speed of the hammer and dimensional constraints for a desired timing. The resistance of the firing pin return spring may also play a role in determining the firing pin length. Other factors may also be considered.

Firing Cycle

Figure 5A:
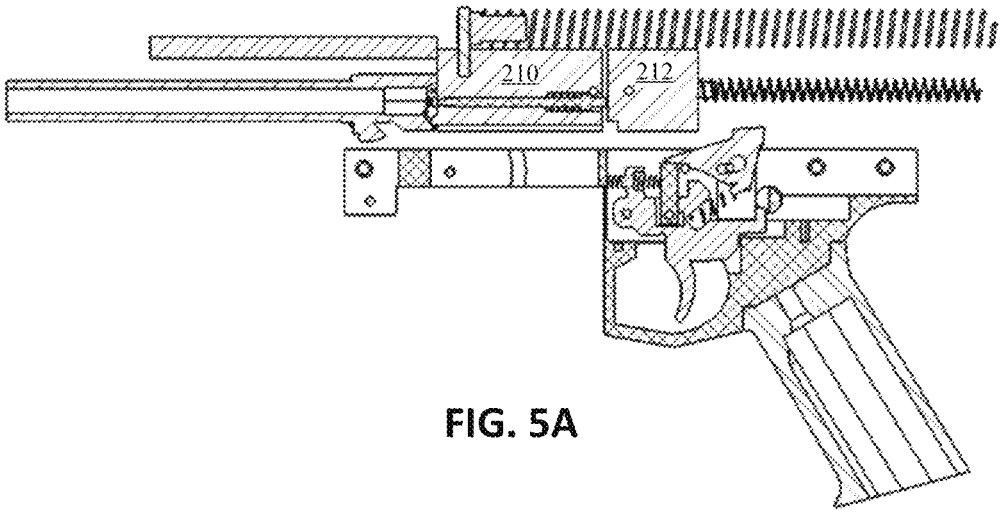
FIGS. 5A through 5G illustrate an example firing cycle of a firearm with an opposing force recoil reduction system.
Figure 5B:
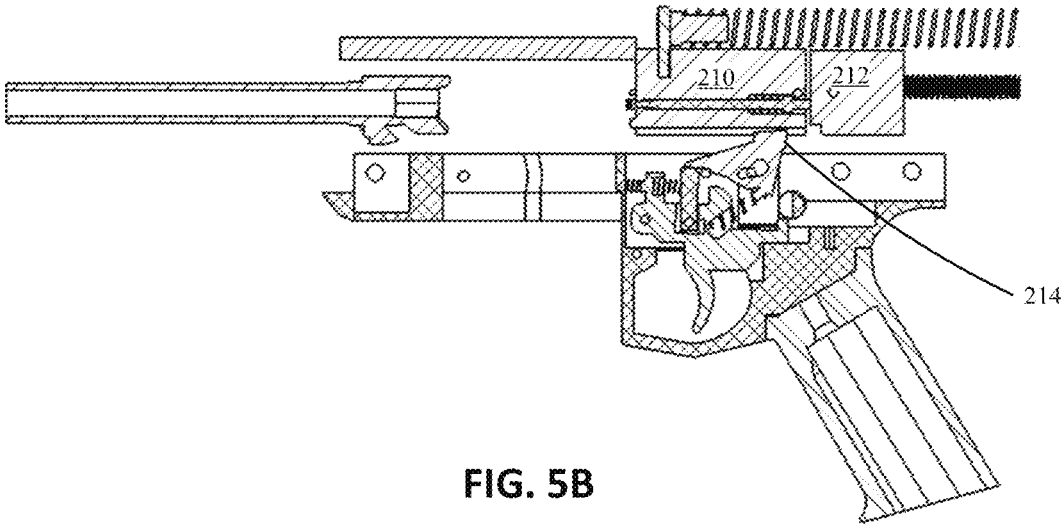
Figure 5C:
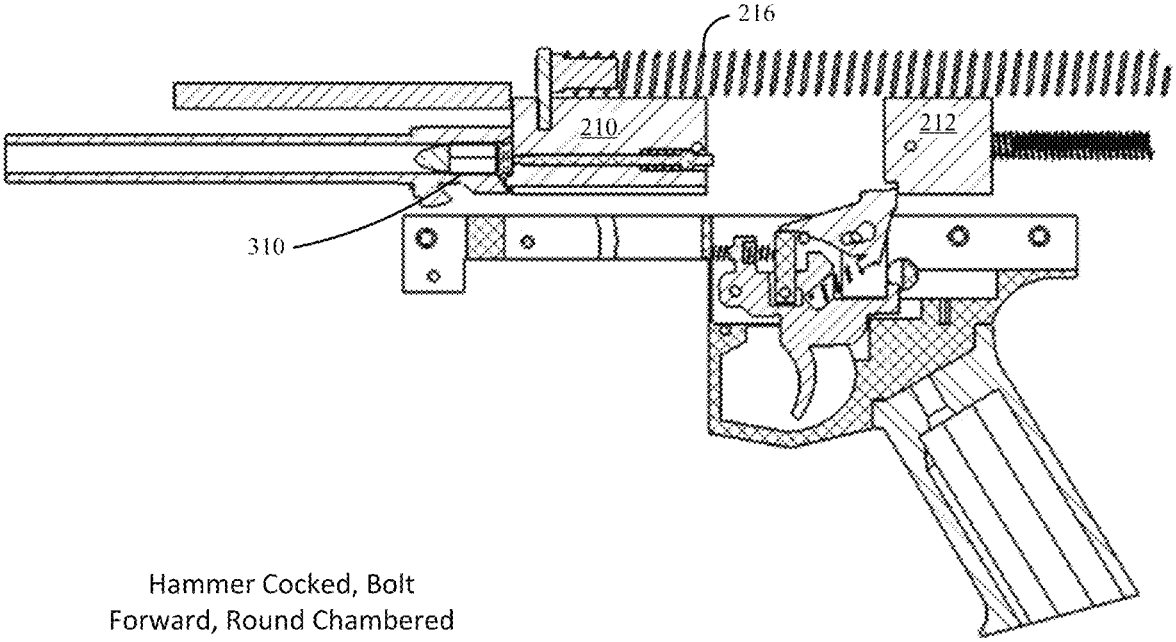

FIGS. 5A through 5G illustrate an example firing cycle of a firearm with an opposing force recoil reduction system. The cycle begins with the bolt 210 closed and the hammer 212 resting against the rear face of the bolt as shown in FIG. 5A. The bolt 210 is then manually pulled rearward by a user via a charging handle as shown in FIG. 5B. The hammer 212 resting behind the bolt 210 is also pushed rearward by the bolt 210. The bolt 210 and hammer 212 move independently, are not connected and use separate return/recoil springs as described above. Once the hammer 212 and bolt 210 have been pushed to the rear portion of the receiver, a sear 214 projecting upwards from the rear lower portion of the receiver locks the hammer into its rearward position. When the charging handle is released, the bolt 210 is propelled forward from by the bolt recoil spring 216. As the bolt 210 moves forward it strips a round 310 from the magazine (not shown) and guides the round into the barrel chamber. The bolt 210 is now closed and a live round 310 is chambered as shown in FIG. 5C.

Figure 5D:
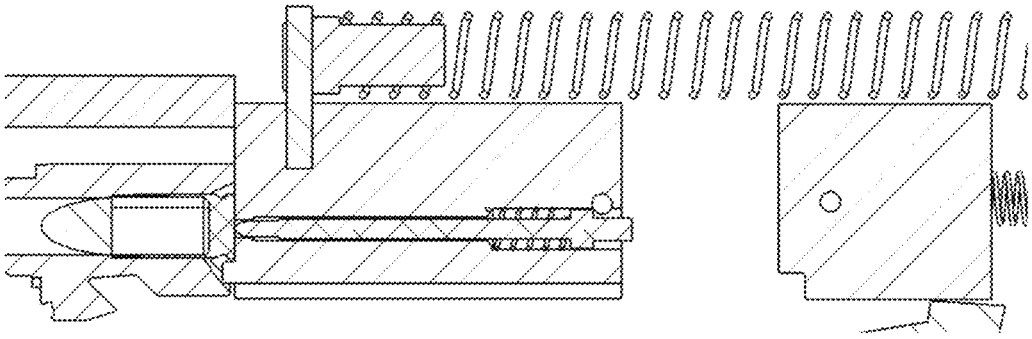
Figure 5E:
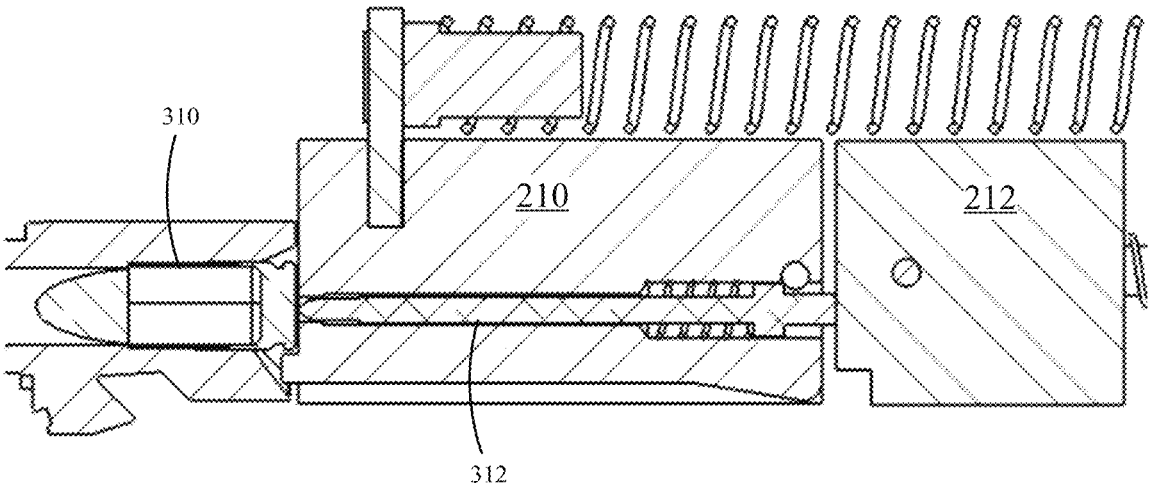
Figure 5F:
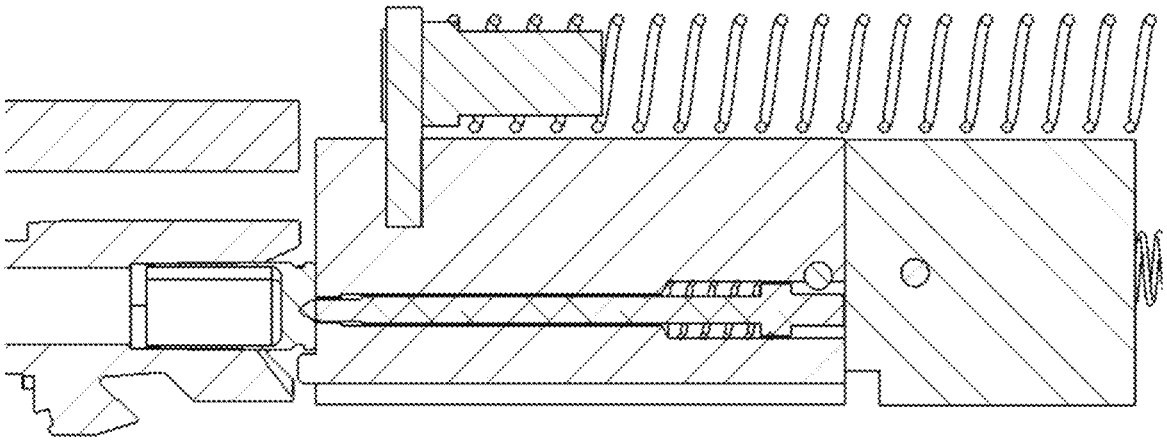

When the user pulls the trigger, the sear moves to release the hammer and the hammer accelerates forward towards the bolt as shown in FIG. 5D. (The firing pin rear section is projected/protruding beyond the rear face of the bolt 210. The distance of projection is used to set the timing.) FIG. 5E shows the hammer 212 striking the firing pin 312. The hammer 212 makes contact with the projected firing pin 312 driving it into the primer of the chambered round 310. The round 310 ignites and pressure begins to increase in the chamber. At this point the hammer 212 face has not yet made contact with the rear bolt 210 face. (There is a slight delay from the time the round is ignited until the bolt begins to move rearward due to inertia and the mass of the closed bolt.) The desired timing would result in a very smooth and low recoil impulse. FIG. 5F illustrates the hammer 212 making contact with the bolt 210. The hammer 212 face makes contact with the rear face of the bolt 210 after the detonation of the round and just as the bolt begins to move reward. The hammer's impact to the rear bolt face has been delayed where the firing pin length determines delay timing. When the hammer makes contact with the rear face of the bolt all of the kinetic energy in the moving mass hammer cancels an equal amount of kinetic energy in the bolt moving rearward (opposite direction of the hammer).

Figure 5G:
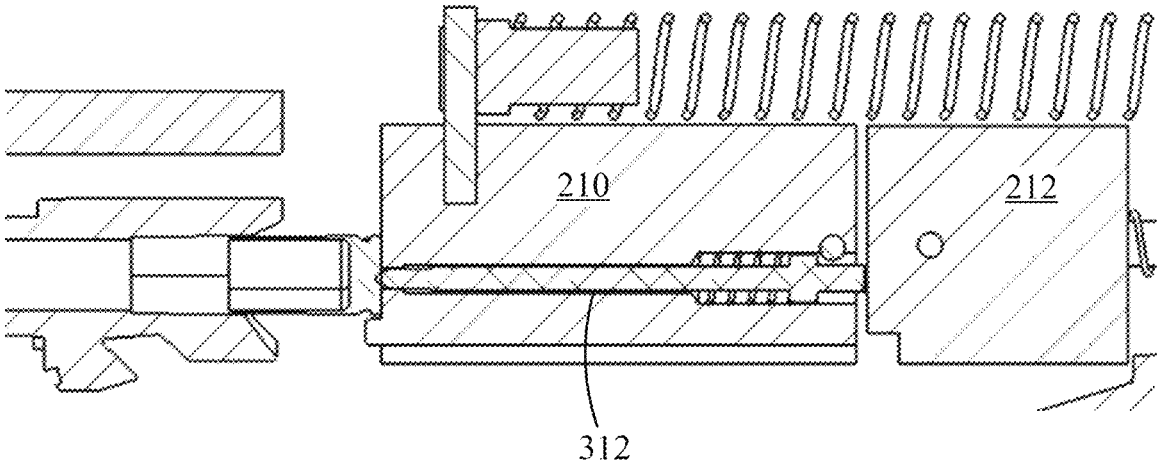

After the hammer 212 makes contact with the bolt 210, the bolt 210 continues to move reward but with reduced speed and energy as shown in FIG. 5G. The hammer may bounce away from the bolt while moving rearward as described below. The bolt 210 still moving rearward pushes the hammer to the rear of the receiver. The hammer recoil springs and bolt recoil spring absorb the remaining energy in the rearward moving bolt and hammer. The hammer 212 locks back into it's rear, ready to fire position via the sear. The bolt recoil spring then pushes the bolt forward, as the bolt passes the magazine it strips a new round from the magazine and pushes it into the chamber. The bolt is now closed, and a new cycle is ready to begin.

Figure 6A:
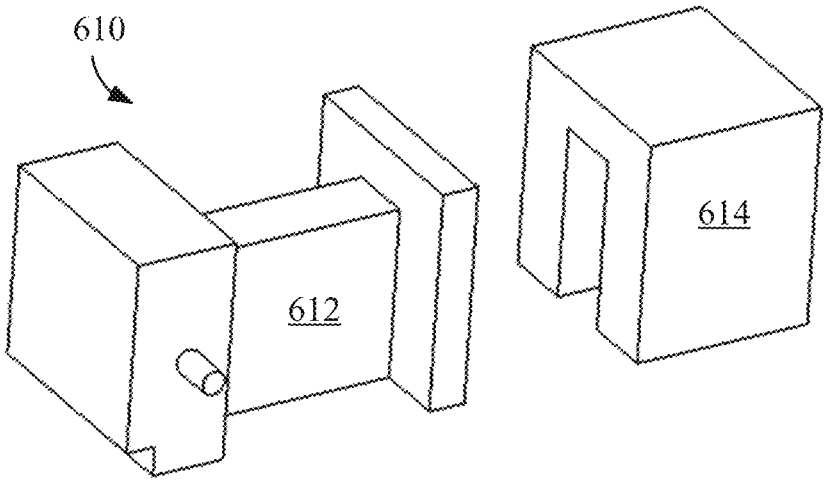
FIG. 6A and FIG. 6B illustrate a two-piece hammer.
Figure 6B:
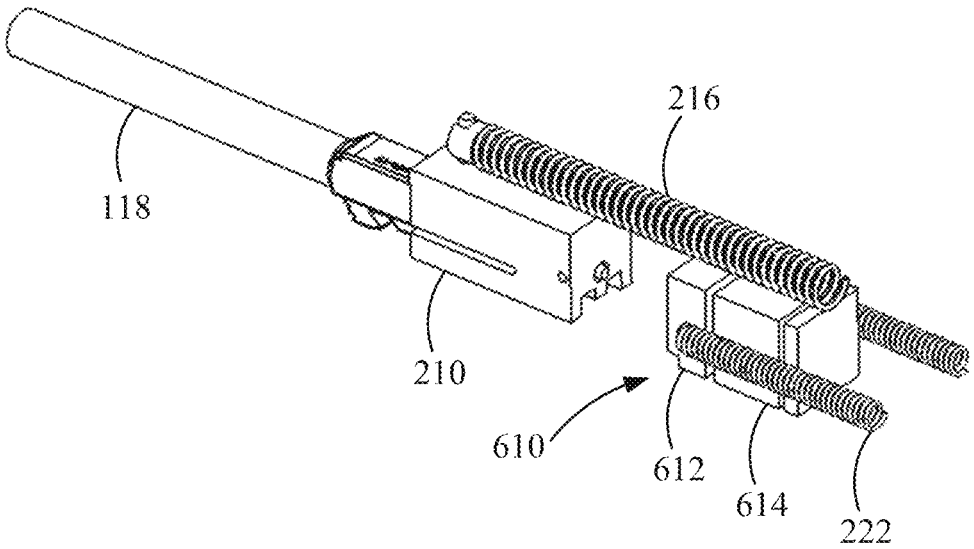

FIGS. 6A and 6B illustrates a two-piece hammer. The two-piece hammer 610 is a single module sub-assembly that contains two independent moving masses. The two pieces of the hammer 610 include a hammer 612 and a sliding weight 614 as shown in FIG. 6A. In this example, the hammer 612 has a saddle area cut out of a center portion of the hammer to accommodate the sliding weight 614. The sliding weight 614 moves freely back and forth within the saddle portion of the hammer and in the direction parallel to the barrel center axis. As described above, the hammer 610 strikes the bolt after the detonation of the primer or after the bolt begins to move rearward therefore reducing some of the bolts kinetic energy. In the two-piece hammer example, the sliding weight 614 portion of the hammer 610 strikes the hammer shortly after the hammer strikes the rear face of the bolt to help eliminate barrel rise and to smooth out the remaining felt recoil as described below with reference to FIG. 7A through 7E. The two-piece hammer 610 is adjustable meaning that the time between the first strike (the hammer) and second strike (the sliding weight) is adjustable in order to accommodate higher caliber ammunition and to further tune the timing for semi-automatic and automatic firearms. The timing of the hammer may be accomplished by adjusting the space between the sliding weight and the hammer which will change the time between the first strike and the second strike.

FIG. 6B illustrates another view of the two-piece hammer introduced in FIG. 6A. In this example, the two-piece hammer 610 is shown in a rearward position from the bolt 210 and the barrel 118. The bolt recoil spring 216 and the hammer springs 222 operate in a similar manner as described above. The hammer springs 222 connects with the hammer 612. The sliding weight 614 moves on the hammer 612 as described further below.

Figure 7A:
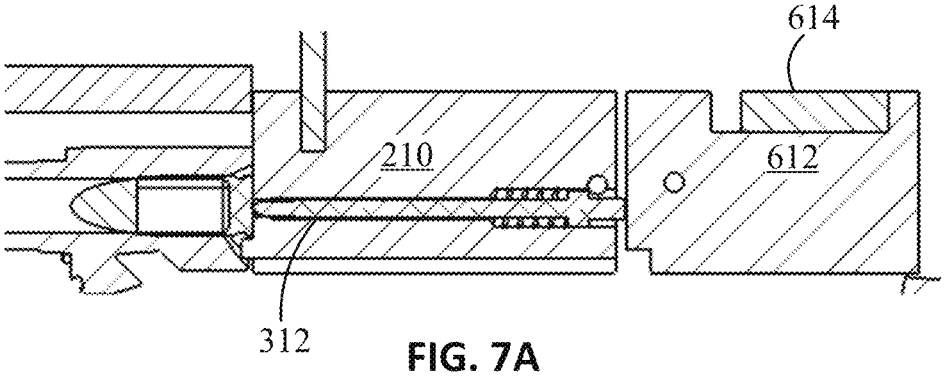
FIGS. 7A through 7E illustrate the sequence of a two piece hammer as the hammer moves through the firing sequence.
Figure 7B:
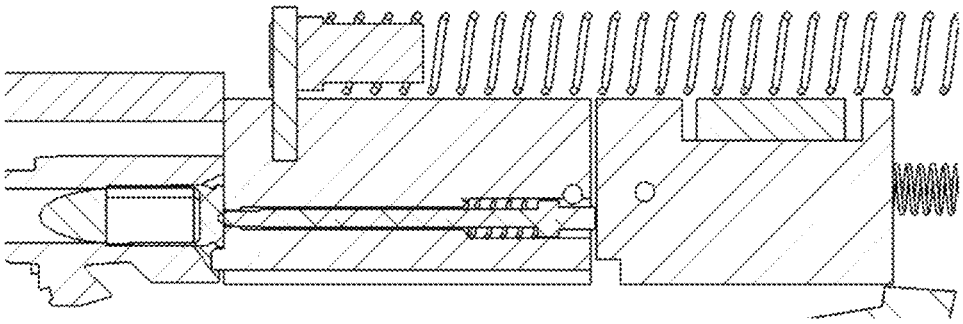
Figure 7C:
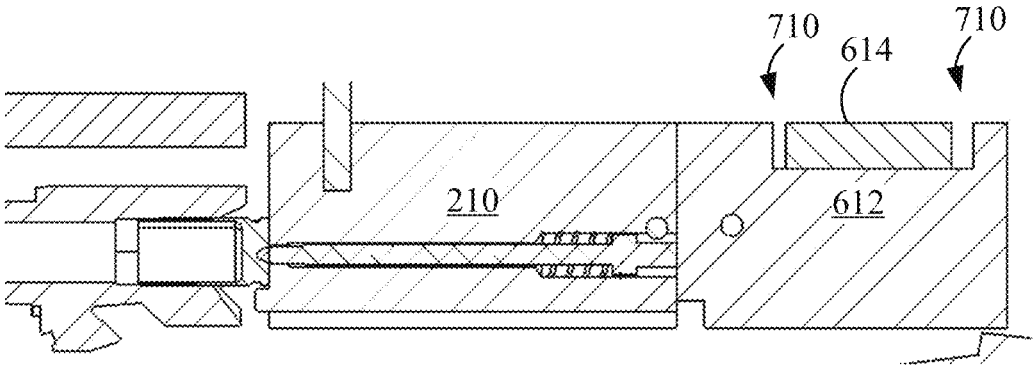
Figure 7D:
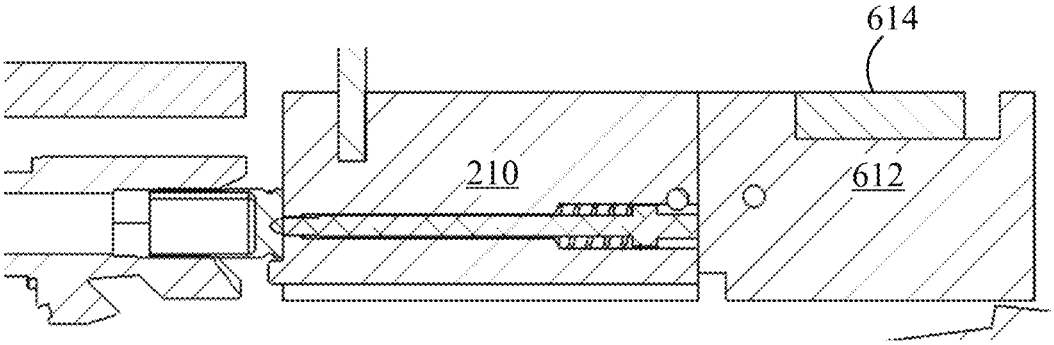
Figure 7E:
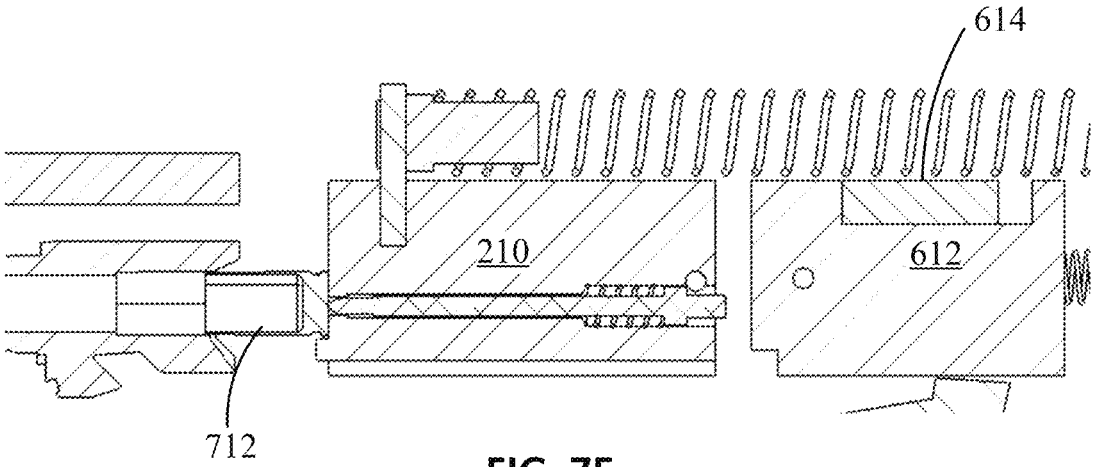

FIGS. 7A through 7E illustrate the sequence of a two-piece hammer as the hammer moves through the firing sequence. FIG. 7A shows the hammer 612 beginning to strike the firing pin 312 as described above with reference to FIG. 5E. FIG. 7B shows the firing pin 312 pressing into the primer of the round sufficient to ignite and fire the round. Initially the sliding weight 614 is in the rearward position due to inertia as shown but begins to move forward after the hammer 612 strikes the firing pin. After the firing pin hits the round as shown in FIG. 7B, the bolt 210 begins to move rearward as the sliding weight 614 is moving forward and the hammer makes contact with the bolt 210 as shown in FIG. 7C. In this example, the U-shaped sliding weight moving forward on the saddle of the hammer 612 is shown by the gap 710 on either side of the sliding weight 614 in FIG. 7C. FIG. 7D shows the sliding weight 614 making contact with the hammer 612 as the bolt 210 is moving rearward due to recoil of the fired round 712. The sliding weight 614 transfers kinetic energy from its moving mass to the hammer and the bolt when the sliding weight 614 impacts the hammer 612 as shown in FIG. 7D. The hammer may bounce away from the bolt while moving rearward as shown in FIG. 7E.

FIG. 8A illustrates a first three-piece hammer. In this example, the hammer 810 includes two sliding weights 812, 814. The two sliding weights 812, 814 are "U" shaped like the sliding weight 614 shown in FIG. 6A to slide on the saddle of the hammer 810 as described above. The two sliding weights 812, 814 act together to apply their combined kinetic energy to the hammer as described above. Since the two sliding weights are separated, they may impact the hammer with a slight delay between them.

FIGS. 8B and 8C illustrates a second three-piece hammer. In this example, the hammer also includes two sliding weights. However, in this example, the two sliding weights move independently on either side of the hammer 820. The two sliding weights are constrained inside the hammer 820 by the upper housing 112 described above.

FIG. 8C illustrates another view of the second three-piece hammer 820. In this view, the two sliding weights 816, 818 can be seen in position on either side of the hammer 820. In this example, the hammer 820 is pressed forward by a single spring 822 that pushes on the hammer 820 between the sliding weights 816, 818. The spring 822 slides on a spring guide 824 that protrudes through the hammer 820. This single spring example has the advantage of a slimmer hammer/spring profile allowing the barrel retainer, upper and endcap described above to have a narrower width and lighter weight.

Figure 8D:
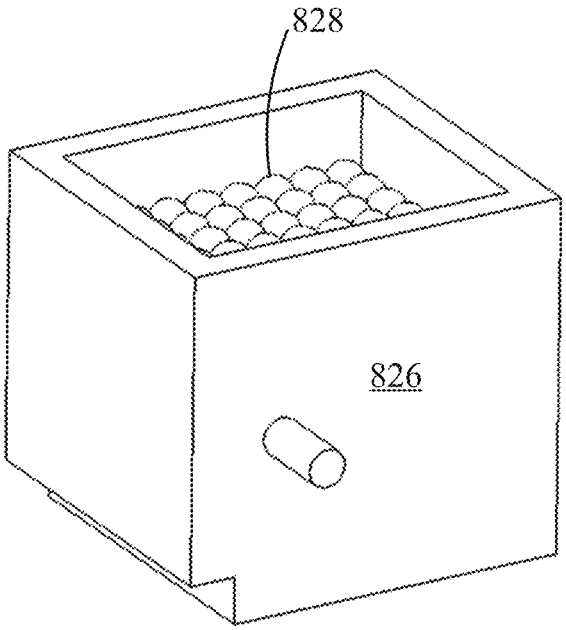
FIG. 8D illustrates another example of a multi-piece hammer.

FIG. 8D illustrates another example of a multi-piece hammer. In this example, the hammer 826 includes a cavity substantially filled with moveable weights. In the illustrated example, the moveable weights comprise spherical lead weights 828. The spherical lead weights 828 are free to move within the hammer 826 and impart kinetic energy to the hammer and the bolt as the hammer impacts the bolt as described above. In other examples, the moveable weights in the cavity of the hammer 826 may be other shapes and made from other materials.

Trigger System

Figure 9A:
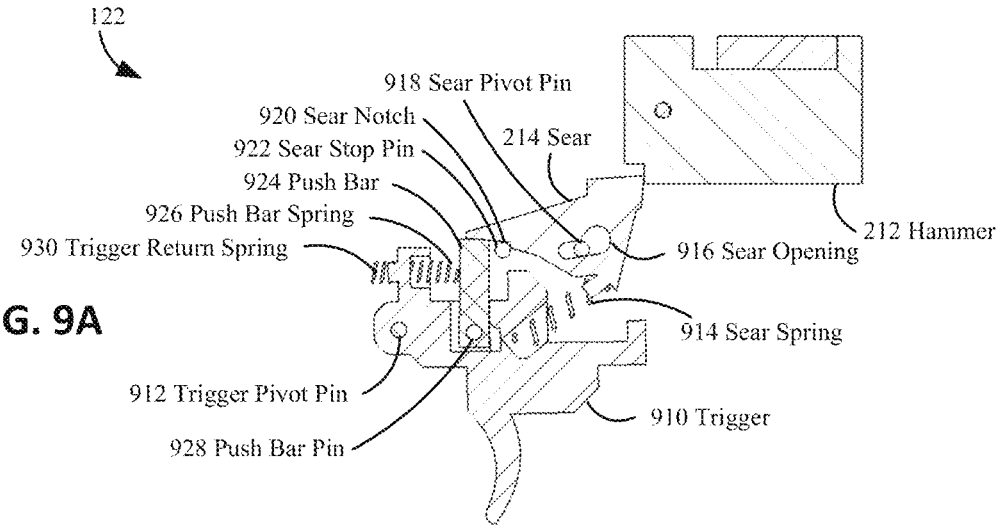
FIGS. 9A through 9H illustrate an example trigger system for a firearm, including a firearm with an opposing force recoil reduction system.

FIGS. 9A through 9H illustrate an example trigger system for a firearm, including a firearm with an opposing force recoil reduction system. FIG. 9A shows the trigger assembly 122 in the ready to fire position. The trigger assembly 122 includes a trigger 910 that rotates or pivots about a trigger pivot pin 912 while compressing a trigger spring 914. The sear 214 has a sear opening 916 for a sear pin 918 and a notch 920 for a sear stop pin 922. A push bar 924 rotates about a push bar pin 928 with push bar spring 928. A trigger return spring 930 returns the trigger when released by the user. In FIGS. 9B through 9F each of these same components are shown but in different stages of the trigger cycle as described below.

In the ready to fire position shown in FIG. 9A, the trigger 910 has not been pulled and the hammer 212 is cocked back and held in place by the sear 214. The sear 214 is in the forward position against the sear pivot pin 918. The push bar 924 is under the sear 214.

Figure 9B:
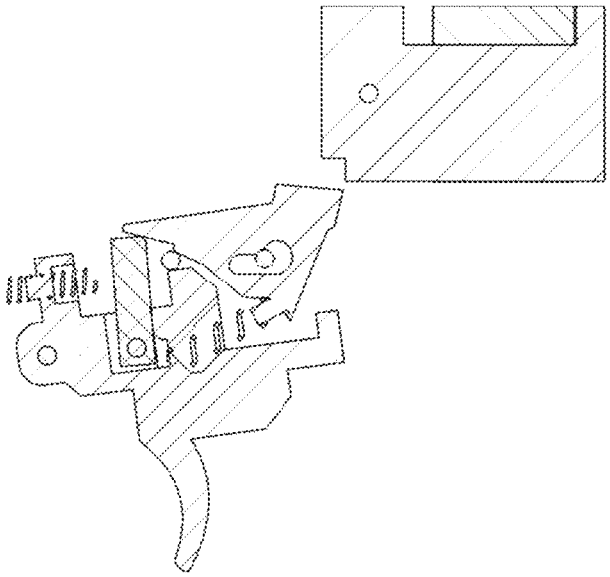

FIG. 9B shows the trigger assembly 122 as the trigger is pulled. The trigger 910 rotates or pivots about a trigger pivot pin 912 while compressing the trigger return spring 930. The push bar 924 pushes up on the sear 214 causing it to pivot on the sear pivot pin 918 and drop downward due to the lobe cutout in the sear opening 916 releasing the hammer 212 which allows the hammer 212 to accelerate forward towards the bolt 210.

Figure 9C:
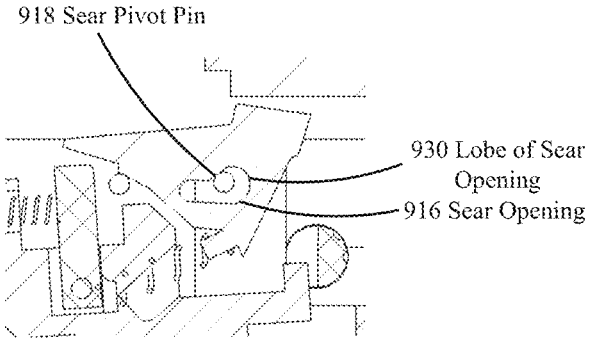

FIG. 9C shows a close-up view of the trigger system to further illustrate the operation of the sear pivot pin 918 in the sear opening 916. The sear opening has a lobe towards the rear of the sear that provides freedom of movement of the sear to rotate and move down from the hammer to allow the hammer to clear the sear as the hammer moves forward.

Figure 9D:
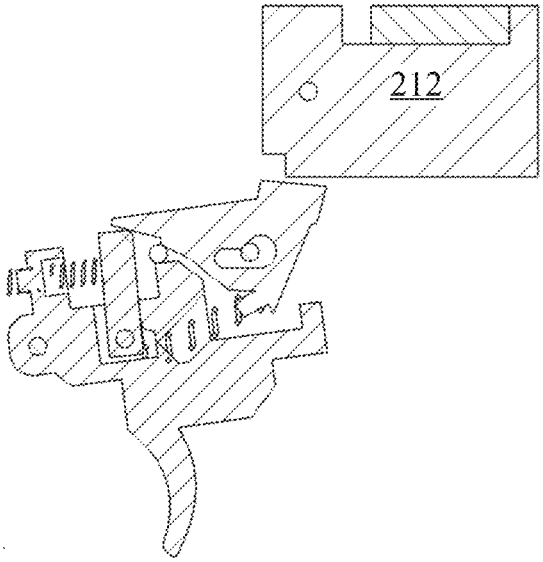
Figure 9E:
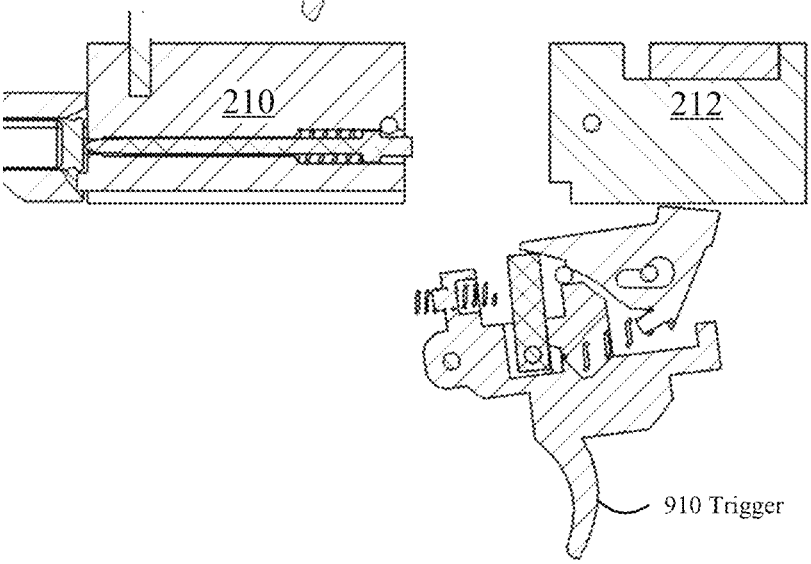

FIG. 9D and FIG. 9E shows the trigger system after the trigger 910 has been pulled and the hammer 212 accelerating forward towards the bolt 210.

Figure 9F:
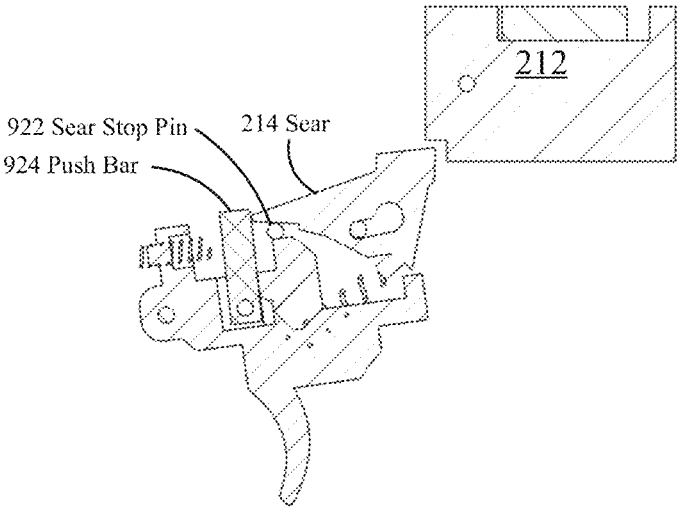

FIG. 9F shows the trigger system after the hammer 910 has been pulled, the round fired and the hammer 212 traveling rearward past the sear 214 due to recoil of the fired round 712 (not shown). The sear 214 has been pushed up and to the right in its rear position by the sear spring 914. The front of the sear 214 is making contact with the sear stop pin 922 where it is ready to catch the hammer 212 when it moves forwards towards the bolt. The sear 214 moving to its rear position allows the push bar 924 to slide in front of the sear 214.

Figure 9G:
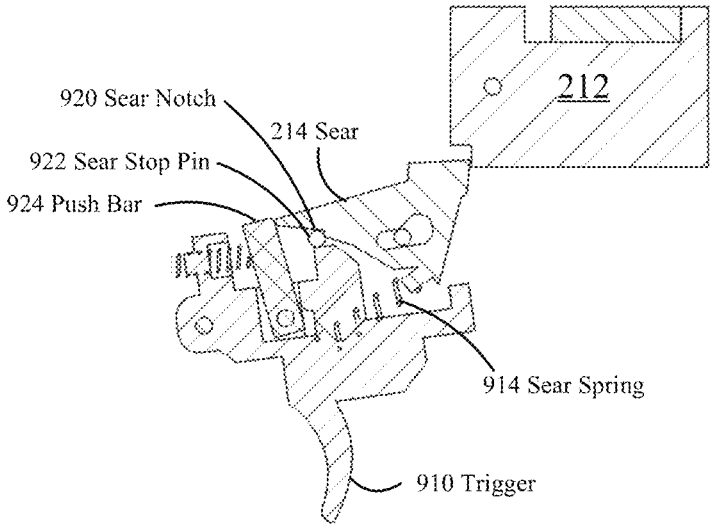

FIG. 9G shows the trigger 910 depressed, the sear 214 has caught the hammer 212 and has moved to its forward position compressing the sear spring 914 and the sear notch 920 has been caught by the sear stop pin 922. The push bar 924 moves counterclockwise compressing the push bar spring.

Figure 9H:
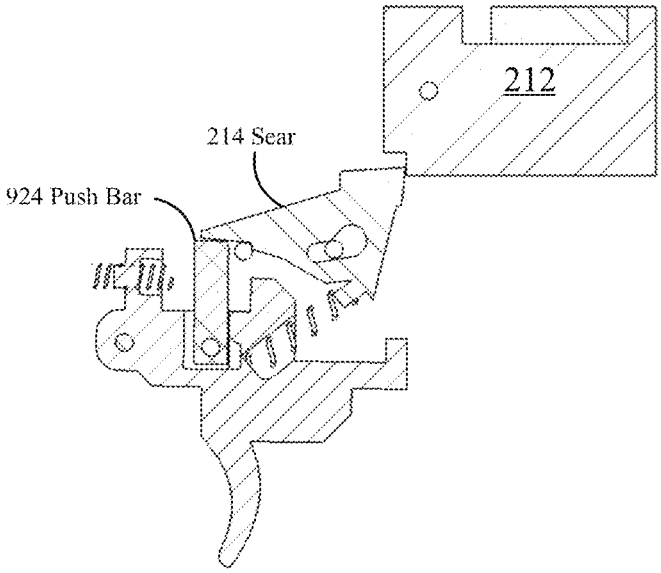

FIG. 9H shows the trigger released after the gun has cycled. With the trigger 910 released the push bar 924 is able to slide under the sear 214 resetting the trigger. The trigger assembly 122 is now in the ready to fire position.

Figure 10:
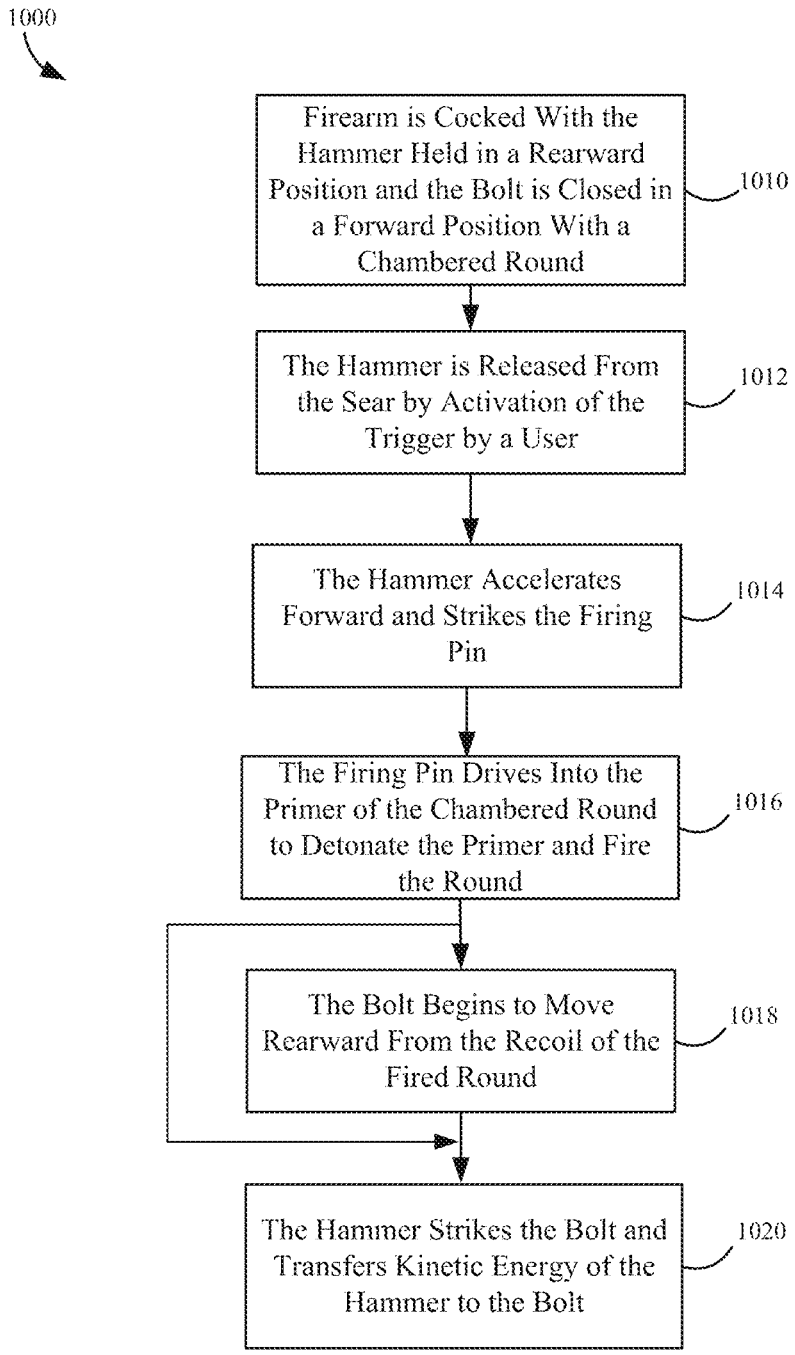
FIG. 10 illustrates an example method 1000 for opposing force recoil reduction in a firearm.

FIG. 10 illustrates an example method 1000 for opposing force recoil reduction in a firearm. The steps of method 1000 may be performed by the firearm described herein in response to actions by a user operating the firearm. The method 1000 begins with the user actuating the charging handle to cock the firearm placing the hammer in a rearward position behind the sear, and then releasing the charging handle to allow the bolt to move to the forward position against a barrel with a round chambered (step 1010). The hammer is released from the sear by activation of the trigger by the user (step 1012). The hammer accelerates forward and strikes the firing pin (step 1014). The firing pin drives into the primer of the chambered round to detonate the primer and fire the round (step 1016). The bolt begins to move rearward from the recoil of the fired round (step 1018). The hammer strikes the bolt and transfers kinetic energy of the hammer to the bolt (step 1020). Alternatively, the method may skip step 1018 and move from step 1016 to step 1020. In this example, the hammer strikes the bolt after detonation of the primer but before the bolt moves rearward.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus, the following claims are hereby incorporated into the Detailed Description, with each claim standing on its own as a separately claimed subject matter.

What is claimed is:

1. A firearm with an opposing force recoil reduction system comprising:

a barrel with a chamber for holding a round;

a bolt that moves within an upper housing from a rearward position to a forward position in contact with the barrel;

a firing pin within the bolt for contacting a primer in the round to fire the round;

a hammer that moves behind the bolt in the upper housing;

a trigger assembly with a sear that holds the hammer in a cocked position for firing;

at least one hammer spring that moves the hammer forward toward the bolt to engage the firing pin and the bolt in response to a user operating the trigger assembly;

wherein the hammer moves forward to engage the firing pin and detonate the primer to fire the round; and wherein the hammer in the same forward movement engages and comes in first contact with the bolt as the bolt moves rearward after the primer is detonated and transfers kinetic energy of the hammer to the bolt thereby reducing recoil of the firearm.

2. The firearm of claim 1, wherein the hammer includes a cavity with a plurality of moveable weights inside a center portion the hammer where the moveable weights provide kinetic energy to the bolt after the hammer contacts the bolt.

3. The firearm of claim 1, wherein the bolt and the hammer have a same shape.

4. The firearm of claim 3, wherein the bolt and hammer are a shape of a cuboid.

5. The firearm of claim 1, wherein a mass of the hammer is about 50% of a mass of the bolt.

6. The firearm of claim 1, wherein a mass of the hammer is greater than 50% of a mass of the bolt.

7. The firearm of claim 1 wherein the sear holds the hammer in the rearward position by engaging the hammer and movement of the sear is controlled by the trigger assembly, and wherein the bolt strips a round from a magazine when moving to the forward position.

8. The firearm of claim 1 wherein the hammer is a two-piece hammer comprising a hammer sliding weight moving on a saddle portion of the hammer and the hammer sliding weight provides kinetic energy to the bolt after the hammer contacts the bolt.

9. The firearm of claim 1 wherein the hammer is a three-piece hammer comprising two hammer sliding weights moving on either side of the center portion the hammer and the hammer sliding weights provides kinetic energy to the bolt after the hammer contacts the bolt.

10. A method for reducing recoil in a firearm comprising:

a. placing the firearm in a cocked state with a hammer held in a rearward position by a sear and a bolt in a forward position against a barrel with a chambered round;

b. releasing the hammer from the sear in response to a user activating a trigger;

c. accelerating the hammer in a forward movement by a hammer spring to strike a firing pin in the bolt;

d. driving the firing pin into a primer of the chambered round to detonate the primer and fire the chambered round; and e. subsequent to the detonation of the primer, in the same forward movement as striking the firing pin, the hammer striking the bolt for the first time as the bolt moves rearward and transferring kinetic energy of the hammer to the rearward moving bolt.

11. The method of claim 10 wherein the hammer includes a cavity with a plurality of moveable weights inside a center portion the hammer where the moveable weights provide kinetic energy to the bolt after the hammer contacts the bolt.

12. The method of claim 10, wherein the bolt and the hammer have a same shape.

13. The method of claim 10, wherein the bolt and hammer are a shape of a cuboid.

14. The method of claim 10, wherein a mass of the hammer is at least 50% of a mass of the bolt.

15. The method of claim 10 wherein the hammer is moved forward by at least one spring attached to the hammer.

16. The method of claim 10 wherein the sear holds the hammer in the rearward position by engaging a slot in front of the hammer and movement of the sear is controlled by the trigger assembly, and wherein the bolt strips a round from a magazine when moving to the forward position.

17. The method of claim 10 wherein the hammer is a two-piece hammer comprising a hammer sliding weight moving on a saddle portion of the hammer and the hammer sliding weight provides kinetic energy to the bolt after the hammer contacts the bolt.

18. The method of claim 10 wherein the hammer is a three-piece hammer comprising two hammer sliding weights moving on either side of the center portion the hammer and the hammer sliding weights provides kinetic energy.

19. The method of claim 18 wherein the hammer is pushed forward by a single spring pushing on the hammer and the spring guided by a spring guide which also protrudes through the hammer.

20. A method for reducing recoil in a firearm comprising:

a. placing the firearm in a cocked state with a hammer held in a rearward position by a sear and a bolt in a forward position against a barrel with a chambered round;

b. releasing the hammer from the sear in response to a user activating a trigger;

c. accelerating the hammer in a forward movement by a hammer spring to strike a firing pin in the bolt;

d. driving the firing pin into a primer of the chambered round to detonate the primer and fire the chambered round;

e. subsequent to the detonation of the primer, in the same forward movement as striking the firing pin, the hammer engages the bolt for the first time as the bolt moves rearward in response to detonation of the primer to transfer kinetic energy of the hammer to the bolt thereby reducing recoil of the firearm; and f. wherein the bolt and hammer are a shape of a cuboid and a mass of the hammer is at least 50% of a mass of the bolt.

* * * * *